United States Patent [19]

Hofer

[11] 4,315,112

[45] Feb. 9, 1982

[54] SPEAKER

[76] Inventor: Alan Hofer, 1201 Tusk La., Wantagh, N.Y. 11793

[21] Appl. No.: 102,753

[22] Filed: Dec. 12, 1979

[51] Int. Cl.[3] ..... H04R 7/16; H04R 9/06

[52] U.S. Cl. ..... 179/115.5 R; 179/115.5 VC; 181/165; 181/167

[58] Field of Search ..... 179/115.5 R, 115.5 VC, 179/181 R; 181/167, 165

[56] References Cited

U.S. PATENT DOCUMENTS

| | | | |
|---|---|---|---|
| 2,037,185 | 4/1936 | Thuras | 179/115.5 R |
| 3,293,379 | 12/1966 | Gorike | 179/115.5 R |
| 3,513,270 | 5/1970 | Warning | 179/115.5 VC |
| 3,586,792 | 6/1971 | Gayford | 179/115.5 VC |
| 3,711,659 | 1/1973 | Bremseth | 179/115.5 VC |
| 3,935,400 | 1/1976 | Koga | 179/115.5 R |
| 4,140,203 | 2/1979 | Niguchi et al. | 181/167 |

FOREIGN PATENT DOCUMENTS

| | | | |
|---|---|---|---|
| 856614 | 11/1952 | Fed. Rep. of Germany | 179/115.5 R |
| 1800152 | 5/1969 | Fed. Rep. of Germany | 179/115.5 R |
| 451664 | 8/1936 | United Kingdom | 179/115.5 VC |

*Primary Examiner*—George G. Stellar

[57] ABSTRACT

An improved speaker is provided for stereo headsets and the like. The diaphragm for the speaker comprises the dome of an inverted polyester film cup centered within a flurocarbon film diaphragm member. The voice coil for the speaker is wound directly about the periphery of the cup and the adhesive joint between the cup and the diaphragm comprises the sole adhesive joint of a diaphragm.

6 Claims, 2 Drawing Figures

SPEAKER

BACKGROUND OF THE INVENTION

The present invention relates to speakers and in particular to speakers of the moving coil type of relatively small diameter for use in stereo headsets and the like.

Heretofore it has been common practice to construct the diaphragm assembly for a moving coil type of headset speaker of three discrete parts. These parts comprise a low frequency diaphragm a high frequency dome and a voice coil form about which the voice coil is wound. The three parts were cemented together to form the completed diaphragm assembly. In this prior art type of construction, two distinct gluing operations were required. That is, the high frequency dome was separated from the voice coil form by adhesive and the low frequency diaphragm was also separated from the voice coil form by an adhesive layer.

It is common knowledge that in a mechanical acoustic driving system, such as a loudspeaker, a phase shift occurs at each change in the density of the material from which the driver is formed. This phase shift results is distortions at specific frequencies.

It is also well known that it is desirable to keep the vibrating system (i.e., the diaphragm-dome assembly) as light-weight as possible in order to achieve the lowest possible free field resonance frequency. With conventional headset two inch speakers now available, this frequency is approximately 450 Hz.

SUMMARY OF THE INVENTION

The principal object of the present invention is to provide an improved speaker construction utilizing a diaphragm assembly having a lighter weight, lower free-field resonance frequency and lower distortion level than was heretofore available.

A further object is to provide such a speaker from minimum number of component parts which may readily be assembled and at competitive prices.

The above and other beneficial objects and advantages are attained in accordance with the present invention by providing a speaker comprising a housing having an open top end. A generally half-torroidal shaped diaphragm formed of a flurocarbon film material partially closes the housing open end. An inverted cup shaped high frequency dome is positioned within the diaphragm center closely fitting against the diaphragm and adhesively secured in position. A voice coil is wound about the cup close to the rim. A magnet assembly including a pole piece and permanent yoke is positioned with the housing with the pole piece and permanent magnet axially aligned with the dome. The yoke includes portions extending about the pole piece and permanent magnet and spaced therefrom with the voice coil captured within the gap between the magnetic pole and yoke.

A single glued joint secures the dome to the diaphragm. Portions of the dome cup serve as the bobbin for the coil and no separate form is required or provided.

DETAILED DESCRIPTION OF THE PREFERRED EMBODIMENT

Figure 1:
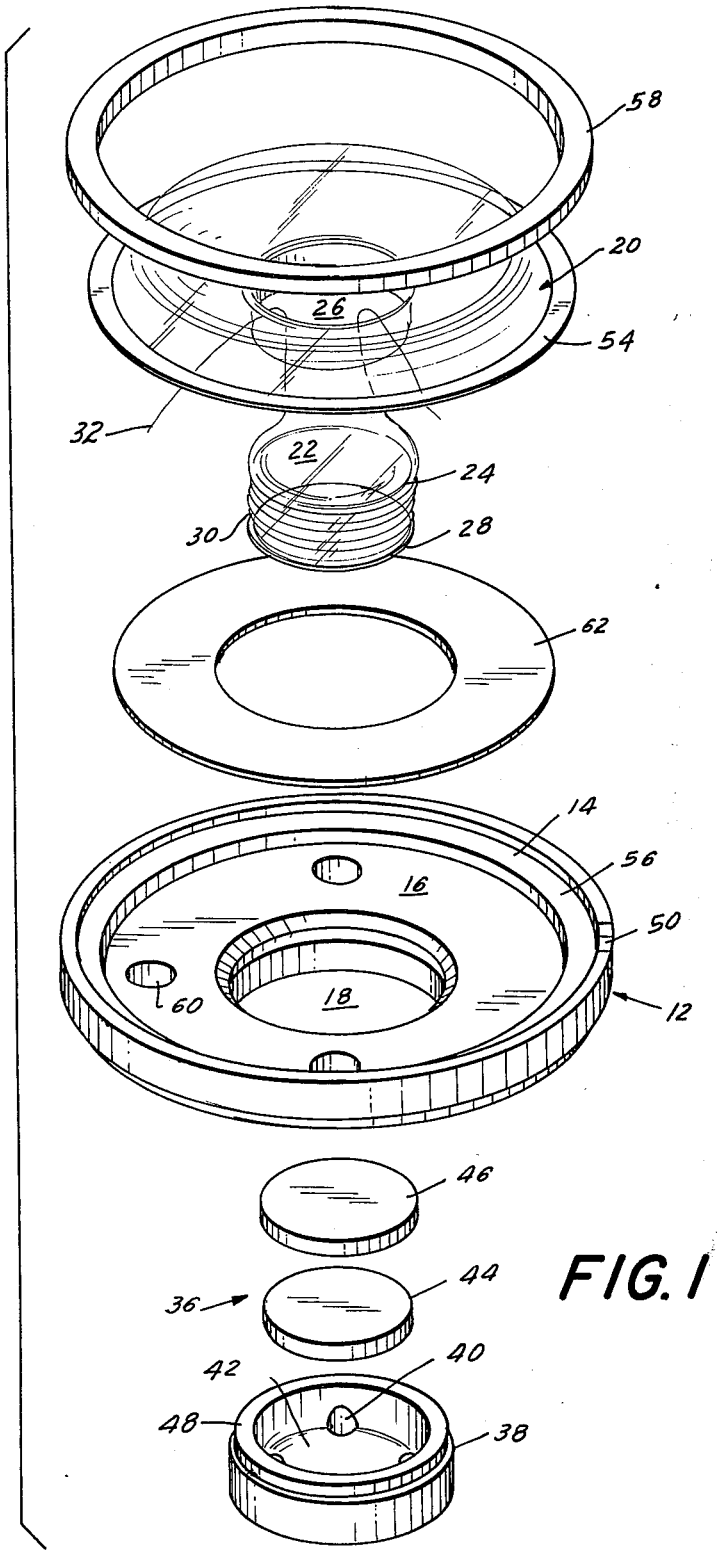
FIG. 1 is an exploded perspective view of the component parts of a speaker constructed in accordance with the present invention.

Reference is now made to the drawings and to FIG. 1 in particular wherein the component parts of a speaker assembly in accordance with the present invention are depicted. The speaker comprises a housing 12 molded of a suitable plastic material such as cycolac-ABS. The housing is formed with an open top end 14 and a bottom end 16 provided with a central circular opening 18.

The speaker further comprises a first, low frequency diaphragm 20 formed of a relatively soft plastic film material. The diaphragm 20 generally has the shape of a torroid sliced in half perpendicular to its axis. This film material for diaphragm 20 must be a relatively soft yet dimentionally stable. Fluropolymer films have been observed to possess the desired properties and in a successful practice of the invention a fluropolymer film available commercially under the trade name Halal from the Allied Chemical Company was utilized.

Diaphragm 20 was selected to be efficient at frequencies below 3000 Hz. High frequencies (i.e., excess of 3000 Hz) are handled by a second diaphragm 22 which comprises the dome of an inverted cup-shaped member 24, the sides of which are dimensioned to fit tightly within the open center portion 26 of diaphragm 20. Cup 24 is formed of a polyester or polycarbonate film material which is harder than the material of diaphragm 20. In a successful practice of the invention, Celenar, a polyester film (available from the Celenese Plastics Co.) was used for cup 24.

As will be noted from FIG. 1, cup 24 is provided at its open bottom end with an outwardly directed rim 28 about which voice coil 30 is directly wound. That is, rim 28 forms the support for voice coil 30 while the sides of cup 24 form the bobbin for the coil. The coil 30 is formed of a fine lacquered copper wire on the order of No. 48 wire.

Cup 24 is inserted into the opening 26 in diaphragm 20 with the ends 32 and 34 of the voice coil looped over the top surface of the diaphragm 20. A suitable adhesive joint at the interface of the inner surface of diaphragm 20 and dome 24 secures the dome in position.

The magnetic assembly 36 for the speaker comprises a magnetic armature and a yoke. Yoke 38 is formed of a suitable magnetic material in the general shape of an upright cup. A series of openings 40 are provided in the bottom 42 of yoke 38. A disc magnetic 44, preferably formed of a rare earth material such as samarium cobalt sits on the base 42 of yoke 38. Magnet 44 is magnetized parallel to the axis of the cup (i.e., along its longitudinal axis). The diameter of magnet 44 is slightly less than the inner diameter of the yoke. The magnet assembly further comprises a pole piece 46 formed of a magnetic material which sits on magnet 44. The diameter of pole piece 46 is slightly greater than that of magnet 44 but still less than the inside diameter of the yoke so that a gap of approximately 20 mils. exist between pole piece 46 and the inside wall of the yoke. The combined heights of magnet 44 and pole piece 46 are equal to the depth of the yoke interior so that when assembled the top of the pole piece aligns with the top rim 48 of yoke 38.

Figure 2:
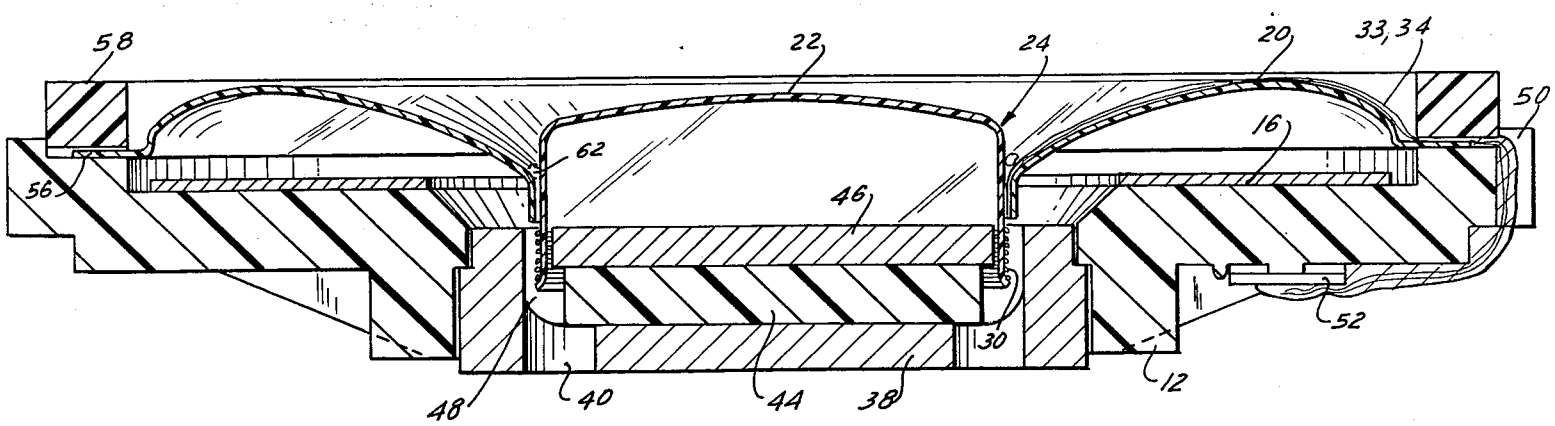
FIG. 2 is a side elevational sectional view of the assembled speaker.

The assembled speaker is shown in FIG. 2. As can be seen, the open end 14 of housing 12 is closed by the diaphragm assembly which consists of low frequency diaphragm 20 and high frequency diaphragm 22. The opening 18 in the bottom of housing 12 is closed by the magnet assembly with the pole-piece extending into the portion of cup 24 about which voice coil 30 is wound. The voice coil is captured in the gap defined between the sides of yoke 38 and the pole piece. The ends of voice coil 30 are brought out over the top of diaphragm 20 through an opening 50 and down the side of housing 12 to a terminal strip 52 mounted to the bottom of the housing.

In order to secure the diaphragm 20 in position on the housing, the diaphragm 20 is provided with a rim 54 at its outer periphery which sets on a shoulder 56 formed in housing 12. A plastic ring 58 tightly snaps over shoulder 56 and is glued in place thereby capturing the diaphragm in position.

The bottom of housing is provided with air ports 60 on the bottom surface 16. The ports are covered by a filter 62 which serves to relieve back pressure and thereby prevent the diaphragm from bouncing on the housing. The filter is formed of conventional filter material such a 5 mil. Filyon available from Filpaco Industries, Inc.

It should be noted that the glue joint between the inverted cup 24 and diaphragm 20 comprise the sole glue joint in the entire diaphragm assembly. The voice coil is wound directly about the outer periphery of cup 24 rather than about a bobbin which must then be secured to the diaphragm assembly. As a result of the above arrangement, vibrations received by virture of the intermagnetic reaction of the voice coil 30 (when energized by incoming signals on leads 32 and 34) are transmitted directly to the dome without any discontinuity of the material such as a cement joint would introduce.

In addition, the low specific gravity and softness of the flurocarbon material used for diaphragm 20, results in a speaker having an exceptionally clean low frequency response with a free-field diaphragm resonance on the order of 350 Hz. A substantial improvement over conventional design.

Thus, in accordance with the above the aforementioned objects are effectively attained.

Having thus described the invention, what is claimed is:

1. A speaker comprising:

a housing having an open top end, a diaphragm assembly closing said top end; said diaphragm assembly comprising a first generally half-torrodial shaped diaphragm member formed of a fluoropolymer film and having an open center section and a second diaphragm member in the form of an inverted cup having a dome positioned in and closing said center section, said second diaphragm member being formed of a plastic film material dissimilar to said first diaphragm member film;

a voice coil wound directly about said cup;

a magnetic assembly positioned within said housing axially aligned with said cup, said magnetic assembly including a magnetic pole piece and permanent magnet magnetized parallel to the axis of said cup and a magnetic yoke, said yoke including portions extending about said pole piece and permanent magnet and spaced therefrom to form a gap within which said voice coil is captured.

2. The speaker in accordance with claim 1 further comprising a glue joint joining said cup and said first diaphragm.

3. The speaker in accordance with claim 1 wherein said coil terminates in a pair of leads extending over said first diaphragm.

4. The speaker in accordance with claim 1 further comprising filter means disposed in said housing underlying said first diaphragm and said housing is provided with openings therein underlying first said diaphragm.

5. The invention in accordance with claim 1 wherein said cup is formed of a harder film material than said first diaphragm.

6. The invention in accordance with claim 1 wherein said cup is formed of a polyester film or polycarbonate film.

* * * * *

UNITED STATES PATENT AND TRADEMARK OFFICE

CERTIFICATE OF CORRECTION

PATENT NO. : 4,315,112

DATED : February 9, 1982

INVENTOR(S) : Alan Hofer

It is certified that error appears in the above-identified patent and that said Letters Patent are hereby corrected as shown below:

On the titel page, column 1, add -- [73] Assignee: Pickering & company --.

On the title page, column 2, add line 9, to read -- Kane, Dalsimer, Kane, Sullivan and Kurucz --.

At Column 1, line 52, -- after "permanent" insert -- magnet and yoke --.

Signed and Sealed this

*Fifteenth* Day of *June 1982*

[SEAL]

*Attest:*

GERALD J. MOSSINGHOFF

*Attesting Officer*

*Commissioner of Patents and Trademarks*